United States Patent [19]

Pereira

[11] Patent Number: 4,860,820

[45] Date of Patent: Aug. 29, 1989

[54] METHOD AND APPARATUS FOR THE LOW-PRESSURE DIE-CASTING OF METALS

[75] Inventor: Joseph A. T. Pereira, Weybridge, England

[73] Assignee: A. W. Plume Limited, Twickenham, England

[21] Appl. No.: 203,589

[22] Filed: May 27, 1988

[30] Foreign Application Priority Data

Jul. 27, 1983 [GB] United Kingdom ..... 8320298

[51] Int. Cl.[4] ..... B22D 17/32

[52] U.S. Cl. ..... 164/457; 164/119; 164/155; 164/306

[58] Field of Search ..... 164/4.1, 119, 120, 150, 164/154, 155, 306, 457

[56] References Cited

U.S. PATENT DOCUMENTS

| | | | |
|---|---|---|---|
| 2,990,592 | 6/1961 | Hursen | 164/155 |
| 3,844,331 | 10/1974 | Py et al. | 164/119 |
| 3,951,199 | 4/1976 | Pereira | 164/155 |
| 4,585,050 | 4/1986 | Merrien et al. | 164/119 |

FOREIGN PATENT DOCUMENTS

| | | | |
|---|---|---|---|
| 2235674 | 2/1973 | Fed. Rep. of Germany | 164/155 |
| 2603903 | 8/1976 | Fed. Rep. of Germany | 164/4.1 |
| 2826060 | 12/1978 | Fed. Rep. of Germany | 164/4.1 |
| 2497471 | 7/1982 | France | 164/306 |
| 1587909 | 4/1981 | United Kingdom | 164/306 |

*Primary Examiner*—Richard K. Seidel

*Attorney, Agent, or Firm*—Learman & McCulloch

[57] ABSTRACT

A low-pressure die casting process in which gaseous pressure is applied to molten metal in a bath (C) in three stages from three pressure applying circuits. The first circuit applies pressure to lift molten metal to the charging aperture of the die. When the presence of the metal at that die is detected by a sensor (8), a datum pressure is established and the further application of gaseous pressure to the molten metal is taken over by a second circuit. When the pressure applied to the molten metal differs from the datum pressure by a predetermined amount, an after pressure is applied to the molten metal by the third circuit.

16 Claims, 1 Drawing Sheet

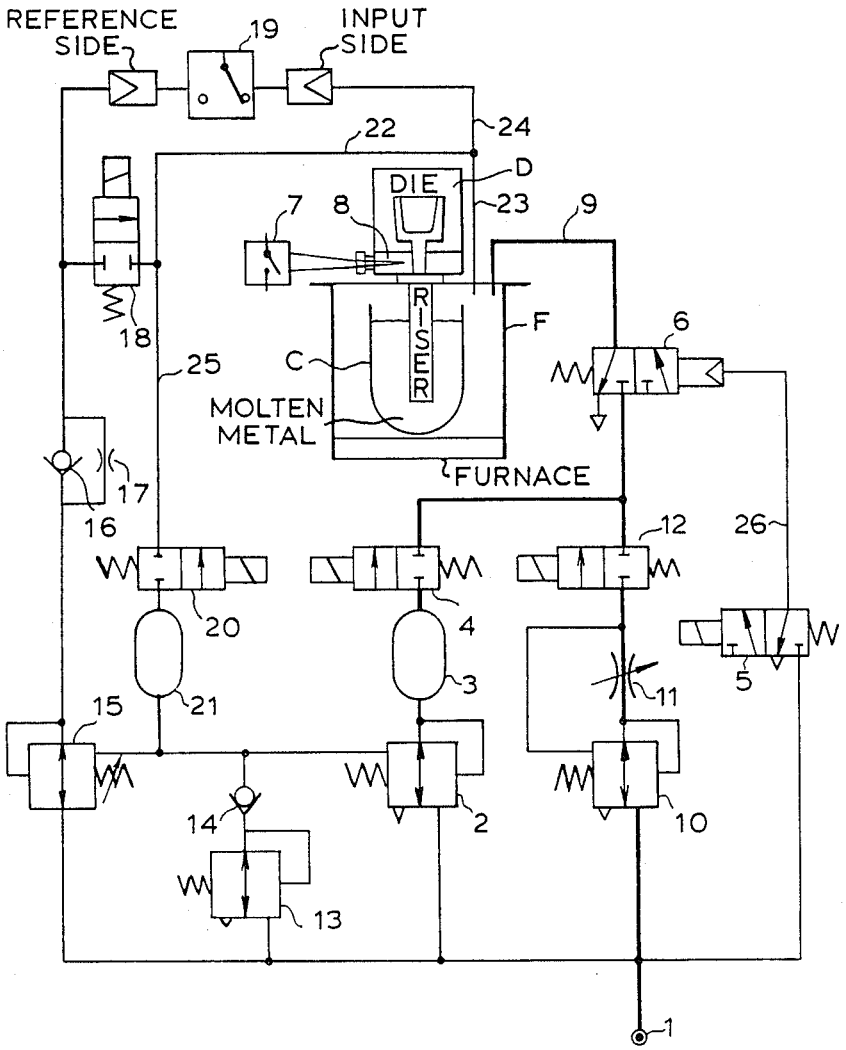
REFERENCE SIDE
19
INPUT SIDE
24
22
D
DIE
23
7
8
9
18
RISER
F
6
25
C
MOLTEN METAL
FURNACE
17
16
12
26
20
4
5
21
3
11
15
14
2
10
13
1

METHOD AND APPARATUS FOR THE LOW-PRESSURE DIE-CASTING OF METALS

This is a continuation of co-pending application Ser. No. 916,295 filed on Oct. 7, 1986, now abandoned, which is a continuation application of Ser. No. 634,215, filed July 25, 1984 (now abandoned).

This invention relates to a method and apparatus for the low-pressure die-casting of metals.

BACKGROUND OF THE INVENTION

In a low-pressure die-casting apparatus, molten metal is forced upwardly through a riser tube having its lower end extending below the level of molten metal in the bath or crucible of a furnace and having its upper end connected to the charging aperture of the die cavity. The molten metal is raised by applying gaseous pressure to the molten metal in the bath; the molten metal rising up the riser tube and into the die cavity, where the metal solidifies. The gaseous pressure is then reduced allowing excess molten metal to fall back down the riser tube to the bath. The casting is then allowed to cool still further after which the die is opened to remove the casting therefrom.

The gaseous pressure used to raise the molten metal from the bath in the furnace into the die cavity, performs two main functions. First, it acts as a pump to transfer the molten metal from the bath up the riser tube and into the die cavity to fill it. The second function is to provide an after-pressure in the molten metal to compact it as it cools in the die cavity. The cooling metal contracts within the die cavity and a certain quantity of metal has to be supplied to the liquid core of the casting to compensate for shrinkage during cooling. As the level of the molten metal in the bath changes due to consumption of the metal or to refilling of the bath, the pressure conditions acting on the molten metal in the bath change.

SUMMARY OF THE INVENTION

The principal factors influencing these pressure changes are the changing volume of gas in the bath and the changing pressure "head" required to raise the molten metal up to the charging aperture of the die cavity as the level of molten metal in the bath changes. This requires a considerable degree of skill on the part of an operator to re-adjust the control settings during the production of a batch of castings to compensate for changes in pressure conditions.

This invention aims at overcoming the problem just referred to.

The present invention provides a low-pressure die-casting apparatus comprising a container for molten metal, a riser tube for conveying molten metal from the source to a die, and a first pressure circuit for applying a gaseous pressure to the molten metal to force the latter through the riser tube to the charging aperture of the die, sensor means for establishing a datum pressure when the molten metal reaches a predetermined level, a second pressure circuit for applying gaseous pressure to the molten metal for forcing the latter into the die cavity at a controlled rate, and a third pressure circuit for applying an after pressure to the molten metal when the die cavity is filled, after pressure being determined by means responsive to a predetermined difference between the datum pressure and the pressure applied to the molten metal to force the latter into the die cavity, pressure in the furnace being maintained at a reference level of a value such that the difference between the after pressure and the datum pressure is maintained at a constant value despite changes in the level of molten metal in the furnace.

The apparatus may include means operable by the sensor for rendering the first circuit inoperative and the second circuit operative when the molten metal reaches the predetermined level.

Means may be provided for rendering the second circuit inoperative and the third circuit operative when the gaseous pressure applied to the molten metal to force the latter into the die reaches the value of the after pressure.

The first circuit may comprise an inlet connectible to a source of gaseous pressure, a gaseous pressure reservoir, a first gaseous pressure control valve with spring bias interconnecting the inlet and the reservoir, and further flow control means connecting the reservoir to the container for molten metal so as to apply gaseous pressure to molten metal therein.

The first valve may be a pilot-pressure-operated valve and in which the first circuit further includes means for applying a pilot pressure to the first valve.

The second circuit may comprise flow control means for interconnecting the inlet and the container for molten metal so as to apply gaseous pressure to molten metal therein.

The third circuit may comprise flow control means interconnecting the inlet and the container for molten metal so as to apply gaseous pressure to molten metal therein.

The flow control means of the third circuit may comprise a second pilot pressure responsive valve with additional adjustable loading, and in which the pilot pressure applied to the second valve is the datum pressure.

The flow control means of the third circuit may also include a further flow control valve connected between the second pilot pressure responsive valve and the container for molten metal and means for operating the valve to apply the after pressure to molten metal in the container when the predetermined pressure difference is achieved.

The sensor means may comprise a sensor for responding when the molten metal reaches the predetermined level, a flow control valve operable by the sensor and interconnecting the source of molten metal and a second reservoir in such manner that the gaseous pressure acting on the molten metal is communicated to the second reservoir, the pressure therein constituting the datum pressure.

The second reservoir may be connected to the second pilot pressure responsive valve to provide the pilot pressure thereto.

The predetermined level may be that of the top of the riser tube or that of the charging aperture.

Further, according to the present invention, a method of low pressure metal die-casting comprises the steps of establishing a datum pressure necessary to raise molten metal to be cast to the level of a die inlet, applying a higher pressure to cause the molten metal to enter the die and fill the latter, and then applying an after pressure to the molten metal of a reference value derived from the datum pressure.

THE DRAWING

The reference value may be derived from the datum pressure by increasing the latter by a predetermined amount.

Apparatus embodying the invention and operable in accordance with the method is illustrated in the accompanying drawing which is a circuit diagram of the apparatus.

THE PREFERRED EMBODIMENT

The apparatus is suitable for low-pressure die casting and comprises a bath or crucible C located in a hermetically sealed furnace F. The bath C contains molten metal which is fed to the cavity of a die D through a riser tube, the lower end of which dips into the molten metal and the upper end of which is connected to the charging aperture of the die cavity. The molten metal is raised from the furnace to the die by gas pressure applied to the space above the metal level through pipe 9 as will be described later.

A first pressure circuit, which comes into effect in the first stage of the casting process when pressure is applied to raise the molten metal from the bath C through the riser tube up to the charging aperture of the die cavity, comprises a source of pressure gas 1 which may be an inert gas, a first, pilot-pressure-operated, pressure control valve 2 with a constant spring bias, a first reservoir 3, a first solenoid-actuated 2-way valve 4, a solenoid-actuated 3-way valve 5, a pressure-operated 3-way valve 6, a pressure control valve 13 and a first non-return valve 14, a second reservoir 21, a second solenoid-operated 2-way valve 20, and a sensor switch 7 actuated by a sensor element located in close proximity to the charging aperture of die D.

In this embodiment, the sensor element 8 is of the thermal type, the switch 7 changing its mode when the temperature of the sensor element 8 rises above a preset value. Such temperature change occurs when molten metal is forced up the riser pipe and reaches the approximate level of the charging aperture. Alternatively, the sensor may be so located that the temperature change occurs when molten metal reaches the level of the top or cap of the riser tube. The gaseous pressure operating in the first stage is introduced into the furnace F via pipe 9. The pressure obtaining in the furnace F during this first stage is communicated to reservoir 21 by pipes 23, 22 and 25 when second solenoid-operated 2-way valve 20 is energised as described below.

A second pressure circuit, which provides the gas pressure during a second stage of the process to raise the molten metal into the die cavity so as to fill it at a controlled rate, comprises the source 1 of pressure gas, a second pilot-pressure-operated, pressure control valve 10 with a constant string bias, a variable flow control valve 11, and a third solenoid actuated 2-way valve 12. The gaseous pressure operating in the second stage is introduced into the furnace F through 3-way valve 6 and pipe 9 described in the first pressure circuit.

A third pressure circuit which is employed to provide, during a third stage of the process, an after pressure to compact the casting after the die is filled, comprises the source 1 of pressure gas, the pressure control valve 13, the first non-return valve 14, a pilot pressure operated pressure control valve 15 with an adjacent spring bias, a second non-return valve 16, a restricted flow orifice 17, a fourth solenoid actuated 2-way valve 18, and a differential pressure switch 19.

The gaseous pressure operating in the third stage is introduced into the furnace F through pipe 22 and pipe 23. The furnace pressure is communicated to the input side of the differential pressure switch 19 by means of pipes 23 and 24.

The first stage of furnace pressurisation is started by simultaneously energising the solenoid actuated valves 4, 5 and 20 by any known control circuit (not shown). Solenoid valve 5 applies an operating pressure to the pressure-operated, 3-way valve 6 through pipe 26, changing the state of valve 6 from the exhaust position shown to a pressurisation position. Reservoir 3 is now connected to the furnace through valves 4 and 6. The gas in reservoir 3 flows into the furnace to lift the molten metal rapidly through the riser tube to the approximate level of the charging aperture of the die cavity. The initial pressure of the gas in reservoir 3 is controlled by the cumulative effect of the pilot pressure generated by pressure control valve 13 and the spring bias of valve 2. The spring pressure applied to valve 13 is set to a value such that the gaseous pressure applied via valve 13 to valves 2 and 15 is sufficient to raise molten metal to the charging aperture when the bath C is full. This initial pressure in reservoir 3 is so arranged that the molten metal is raised substantially up to the charging aperture of the die cavity when the bath is in the fully charged condition. In addition, reservoir 21 is brought up to the pressure in the furnace via pipes 23, 22 and 25 and operated valve 20.

After the gas in reservoir 3 has fully expanded, the pressure in the furnace and the molten metal in the riser tube continue to rise at a reduced rate under the action of pressure control valve 2, which tries to recharge the reservoir 3 to its initial pressure. The sensor element 8 monitors the rise in temperature at the charging aperture and when the temperature reaches a preset value, the sensor switch 7 changes its mode.

The changeover of switch 7 causes the solenoid valves 4 and 20 to be de-energised, and solenoid valve 12 to be energised. Solenoid valve 5 is maintained in the energised stage. With solenoid valve 20 de-energised, the furnace pressure at switchover is communicated to reservoir 21 and stored therein for the rest of the pressurisation cycle and this pressure provides the datum pressure level for pressure control valve 15 as will be described later.

On changeover of sensor switch 7, the process proceeds to the second stage and the furnace is connected to the second pressure circuit in order to raise the molten metal to fill the die cavity. Gaseous pressure is applied to the molten metal through pressure control valve 10, flow control valve 11, energised solenoid valve 12 and 3-way valve 6. Flow control valve 11 is manually preset to provide a gas flow rate best suited for filling the die. The pilot operated pressure control valve 10 maintains a constant pressure difference across the flow control valve 11. Valves 10 and 11 used in this manner provide a constant flow of gas, unaffected by downstream pressure conditions. Such valves are well known in the art.

The adjustable spring bias of pressure control valve 15 is manually preset during the initial setting-up of the apparatus. The pressure obtaining from pressure control valve 15 is dependent on the combined effect of its spring bias and the datum pressure applied as a pilot pressure from reservoir 21. This output pressure from valve 15 is applied, via non-return valve 16 and parallel connected flow orifice 17, to the reference side of the differential pressure switch 19, and will be referred to as the after pressure, the value of the after pressure being termed the reference value. Non-return valve 16 and flow orifice 17 have the effect of preventing any drop in pressure on the reference side of the differential pressure switch.

The gaseous pressure applied to the furnace rises under the influence of the second pressure circuit, and is applied to the input side of differential pressure switch 19. When the furnace pressure reaches the level of the reference value, the differential pressure switch 19 changes its mode, and the third pressure circuit takes over from the second pressure circuit and the process proceeds to its third stage.

On changeover of the differential pressure switch 19, solenoid valve 12 is de-energised, and the solenoid valve 18 is energised. Solenoid valve 5 remains energised. Gas at pressure equal to the reference value is supplied direct to the furnace through valve 18 and pipes 22 and 23 as an after pressure. The after pressure in the furnace is maintained at the reference value for a predetermined period to allow the metal in the die to solidify. This is effected by a suitable delay incorporated in the electrical control circuit. When the delay has expired, solenoid actuated valve 5 is de-energised, 3-way valve 6 changes over to exhaust the pressure gas in the furnace, whereby the excess metal in the riser tube is allowed to fall back into the bath.

It can be appreciated that the reference value is determined by the datum pressure and the setting of the spring bias of valve 15, and the difference between the reference value and the datum pressure is thus independent of the level of molten metal in the bath C.

No adjustment of the apparatus is required during a production run. The constant predetermined difference between the reference value and the datum pressure is adjusted to a required value during the initial setting-up of the apparatus by adjusting the spring loading of valve 15, and the rate of fill of the die cavity is set before the commencement of a production run by setting flow control valve 11 to an appropriate value.

I claim:

1. A low pressure die-casting apparatus comprising:

(i) a container for molten metal, (ii) a riser tube for conveying molten metal from said container to a die having a charging aperture in communication with a cavity, (iii) a first pressure circuit for applying a first gaseous pressure to the molten metal to force the latter through the riser tube to the charging aperture of the die, (iv) a second pressure circuit for applying a second gaseous pressure to the molten metal for forcing the latter into the cavity of the die at a controlled rate, (v) sensor means for establishing for each successive charging operation a datum pressure when the molten metal reaches a predetermined level adjacent said aperture and for causing changeover from said first to said second pressure, (vi) means for storing gas at a datum pressure, (vii) a third pressure circuit for applying an after pressure to the molten metal when the die cavity has been filled, the after pressure having a reference value equal to the stored datum pressure plus a constant predetermined difference, said third pressure circuit including pressure control means supplied from a source of pressure gas independently of said first and second pressures and controlled by the datum pressure so as to supply and maintain constant the required after pressure, and (viii) means in communication with and responsive solely to the second and after pressures to cause changeover from the second pressure to the after pressure at the time the second pressure has risen to that of the reference value and thereafter continuously apply the after pressure on said molten metal until the molten metal in the die has solidified, (ix) whereby the after pressure is applied during solidification, and despite changes in the molten metal level in the container during successive charging operations, the difference between the after pressure and the datum pressure remains constant.

2. Apparatus as claimed in claim 1 and further comprising means operable by the sensor means for rendering the first circuit inoperative and the second circuit operative when the molten metal reaches the predetermined level.

3. Apparatus as claimed in claim 2 in which means are provided for rendering the second circuit inoperative and the third circuit operative when the gaseous pressure applied to the molten metal to force the latter into the die reaches the value of the reference value.

4. Apparatus as claimed in claim 1 in which means are provided for rendering the second circuit inoperative and the third circuit operative when the gaseous pressure applied to the molten metal to force the latter into the die reaches the value of the reference value.

5. Apparatus as claimed in claim 1 in which the first circuit comprises an inlet connectible to a source of gaseous pressure, a gaseous pressure reservoir, a first gaseous pressure control valve with spring bias interconnecting the inlet and the reservoir, and further flow control means connecting the reservoir to the container for molten metal so as to apply gaseous pressure to molten metal therein.

6. Apparatus as claimed in claim 5 in which the first valve is a pilot-pressure-operated valve and in which the first circuit further includes means for applying a pilot pressure to the first valve.

7. Apparatus as claimed in claim 5 in which the second circuit comprises flow control means for interconnecting the inlet and the container for molten metal so as to apply gaseous pressure to molten metal therein.

8. Apparatus as claimed in claim 1 in which the flow control means of the third circuit includes a second pilot pressure responsive valve with additional adjustable loading, and in which the pilot pressure applied to the second valve is the datum pressure.

9. Apparatus as claimed in claim 1 in which the flow control means of the third circuit also includes a further flow control valve connected between the second pilot pressure responsive valve and the container for molten metal and means for operating the valve to apply the after pressure to molten metal in the container when the predetermined pressure difference is achieved.

10. Apparatus as claimed in claim 1 in which the sensor means comprises a sensor for responding when the molten metal reaches the predetermined level, a flow control valve operable by the sensor and interconnecting the container for molten metal to a second reservoir in such manner that the gaseous pressure acting on the molten metal is communicated to the second reservoir, the pressure therein constituting the datum pressure.

11. Apparatus as claimed in claim 10 in which the second reservoir is connected to the second pilot pressure responsive valve to provide the pilot pressure thereto.

12. Apparatus as claimed in claim 1 in which the predetermined level is that of the top of the riser tube or that of the charging aperture.

13. Apparatus as claimed in claim 1 wherein said third pressure circuit includes pressure control means having an inlet connected to a source of pressure gas so as to be supplied independently of said first and second means, an outlet connected to the container for supplying the after pressure, a pilot inlet connected to the means for storing said datum pressure gas for operating the pressure control means in one sense, an adjustable control determining the pressure difference for operating the pressure control means in the same sense, and means for applying the after pressure to operate the pressure control means in the opposite sense to the effect of the datum pressure and adjustable control so as to maintain the after pressure at the reference value represented by said datum pressure plus said predetermined difference determined by the adjustable control.

14. A method as claimed in claim 13 in which the value of the after pressure is derived from the datum pressure by increasing the latter a predetermined amount.

15. A method of low-pressure die casting comprising the steps of:

(i) applying a first gaseous pressure to molten metal to be cast to convey such metal from a source thereof to a die cavity in a succession of charging operations, (ii) storing for each successive charging operation the value of a datum pressure necessary to carry the molten metal to a charging aperture of the die, (iii) thereupon applying a second pressure to carry the molten metal into the die cavity, (iv) deriving an after pressure supply independent of said first and second pressures having a reference value equal to the stored datum pressure for that charging operation plus a constant predetermined difference, (v) detecting when the value of the second pressure has risen to that of the reference value, (vi) removing the second pressure whenever it has risen to that of the reference value and applying the after pressure until the metal in the die has solidified, and (vii) continuously monitoring and controlling the after pressure being supplied to maintain it constantly at the desired value until the metal in the die has solidified.

16. A method of low-pressure die casting comprising applying to molten metal in a furnace a gaseous pressure sufficient to convey the molten metal to a charging aperture of a die and thereafter to fill the die, storing a datum pressure at the charging aperture to compensate for variance of the furnace pressure prior to each casting operation; adding to said datum pressure a pressure independent of said gaseous pressure to obtain a reproducible value after pressure; and continuously monitoring and controlling said after pressure during solidification of the metal in the die to maintain said after pressure at the reproducible value.

* * * * *